US007654920B2

(12) United States Patent
Perry

(10) Patent No.: US 7,654,920 B2
(45) Date of Patent: Feb. 2, 2010

(54) MULTI-PURPOSE GOLF ACCESSORY ASSEMBLY

(76) Inventor: Thomas Wayne Perry, 3211 Brill Rd., Indianapolis, IN (US) 46227

( * ) Notice: Subject to any disclaimer, the term of this patent is extended or adjusted under 35 U.S.C. 154(b) by 0 days.

(21) Appl. No.: 12/155,570

(22) Filed: Jun. 6, 2008

(65) Prior Publication Data

US 2009/0054178 A1 Feb. 26, 2009

Related U.S. Application Data

(60) Provisional application No. 60/965,848, filed on Aug. 23, 2007.

(51) Int. Cl.
*A63B 57/00* (2006.01)
*A63B 69/36* (2006.01)

(52) U.S. Cl. ..... 473/408; 473/257

(58) Field of Classification Search ..... 473/408, 473/406, 285, 286, 257; D21/793; 101/127, 101/127.1; D19/40
See application file for complete search history.

(56) References Cited

U.S. PATENT DOCUMENTS

| | | | | | |
|---|---|---|---|---|---|
| 3,870,299 | A | * | 3/1975 | Howe | 473/408 |
| D247,452 | S | * | 3/1978 | Kitay | D21/793 |
| 4,386,774 | A | * | 6/1983 | Buckman | 473/408 |
| D308,713 | S | * | 6/1990 | Sherry | D21/793 |
| 5,110,123 | A | | 5/1992 | Larson | |
| 5,133,556 | A | * | 7/1992 | Karasavas | 473/257 |
| 5,393,052 | A | | 2/1995 | Kennedy | |
| 5,401,019 | A | * | 3/1995 | Wissman et al. | 473/408 |
| D383,825 | S | * | 9/1997 | Rhodes | D21/793 |
| 5,733,208 | A | * | 3/1998 | Fazekas | 473/406 |
| 6,004,223 | A | * | 12/1999 | Newcomb | 473/257 |
| 6,030,298 | A | | 2/2000 | Tate | |
| 6,033,322 | A | | 3/2000 | England | |
| D422,664 | S | * | 4/2000 | Tate | D21/793 |
| 6,050,905 | A | | 4/2000 | Tate | |
| 6,176,792 | B1 | * | 1/2001 | Tate | 473/408 |
| 6,216,587 | B1 | | 4/2001 | Foley | |
| 6,676,544 | B2 | * | 1/2004 | Tyke | 473/406 |
| D497,948 | S | * | 11/2004 | Miller | D19/40 |
| 6,893,357 | B1 | * | 5/2005 | Bennett | 473/408 |
| 7,004,858 | B2 | | 2/2006 | Bauley et al. | |
| 7,070,519 | B2 | | 7/2006 | Bellagamba | |
| 7,226,370 | B1 | | 6/2007 | Cope | |
| D567,319 | S | * | 4/2008 | Beard | D21/793 |
| 2006/0135289 | A1 | * | 6/2006 | Tsai | 473/408 |

* cited by examiner

*Primary Examiner*—Steven Wong

(57) ABSTRACT

A multi-purpose golf accessory assembly comprises an elongated body member having a number of components mounted thereon. The components include a divot green repair tool, a magnetically secured marker and a golf ball marking instrument. The components are configured in such a way as to provide a golfer with a compact hand-held implement that is easily and conveniently utilized while the golfer engages in a round of golf.

1 Claim, 1 Drawing Sheet

MULTI-PURPOSE GOLF ACCESSORY ASSEMBLY

CROSS-REFERENCE TO RELATED APPLICATION

This application claims priority to the following Provisional Patent Application No. 60/965,848, entitled "Crosshairs Divot Tool", filed Aug. 23, 2007. The contents of the aforementioned provisional patent application is hereby incorporated by reference in its entirety.

FIELD OF THE INVENTION

The present invention relates to a multi-purpose golf accessory assembly that generally comprises an elongated body member having a number of accessory components mounted thereon. More specifically, the accessory components include a divot green repair tool, a magnetically secured marker and a golf ball marking instrument. The accessory components are configured in such a way as to provide a golfer with a compact hand-held implement that is easily and conveniently utilized while the golfer engages in a round of golf.

BACKGROUND OF THE INVENTION

The golfer faces a number of challenges when playing a round of golf, which challenges require the use of golf accessories. For example, after teeing off, the golfer reviews the golf green area to repair any damaged area due to the ball hitting the surface of the green. If there is damage, then the golfer needs a divot tool to repair the damaged area. Another example of a golf accessory is the use of a marker piece to mark the location of a ball to permit play through by other golfers. Another example of a golf accessory is a marking instrument or stencil for use in marking the ball for alignment and sighting purposes. Such a tool can assist the golfer in aligning a golf shot from the tee area and in aligning a putt. Further such a tool will assist the golfer in striking the golf ball on the intended line in order to 'hole' more putts, to drive straight towards the target and thus, to provide a lower golf score.

Golf devices combining a number of tools into a single implement are known in the prior art. Some examples are the following: U.S. Pat. No. 5,110,123 to Larson discloses a golf tool combination of a divot repairer and a ball marker/spotter. U.S. Pat. No. 5,393,052 to Kennedy discloses a golfing device for divot repair/club holding/ball mark retention. U.S. Pat. No. 6,030,298 to Tate discloses a divot tool with a ball marker and a brush. U.S. Pat. No. 6,033,322 to England discloses a golf tool for holding a ball marker and for repairing divots. A magnetic top surface holds the ball marker in place. U.S. Pat. No. 6,050,905 to Tate discloses a divot tool with a ball marker. U.S. Pat. No. 6,216,587 to Foley discloses a golf ball marking assistance device that includes a template shaped to engage a golf ball to be marked. U.S. Pat. No. 7,004,858 to Bauley et al. discloses a golf ball marker retainer and divot repair device combination. U.S. Pat. No. 7,070,519 to Bellagamba describes a divot repair and removable ball marker. U.S. Pat. No. 7,226,370 to Cope discloses a removable golf ball marker that is magnetically secured to a base.

There is a need in the art for a multi-purpose golf accessory assembly that comprises a divot repair tool, a ball marker, and a ball marking stencil mounted on a single elongated body member. In addition, such an assembly should be of a relatively simple design and construction. Further, such an assembly should be aesthetically pleasing.

SUMMARY OF THE INVENTION

It is therefore an object of the present invention to provide a multi-purpose golf accessory assembly that comprises an elongated body member having accessory components mounted thereon.

Another object of the present invention is to provide a multi-purpose golf accessory assembly on an elongated body member that provides the golfer with a number of accessory functions during a round of golf.

Another object of the present invention is to provide a multi-purpose golf accessory assembly that combines multi-different functions on a hand-held implement on a single elongated body member.

Another object of the present invention is to provide a compact multi-purpose golf accessory assembly that combines a number of accessory components on a single implement; namely, a divot green repair tool, a golf ball marker, and a golf ball marking instrument. All of the accessory components of the instant invention are mounted on a single elongated body member.

The instant invention may be described with greater clarity and particularity by reference to the accompanying drawing.

BRIEF DESCRIPTION OF THE DRAWING

The invention is described with reference to the several figures of the drawing, in which.

DESCRIPTION OF THE EMBODIMENT

Figure 1:
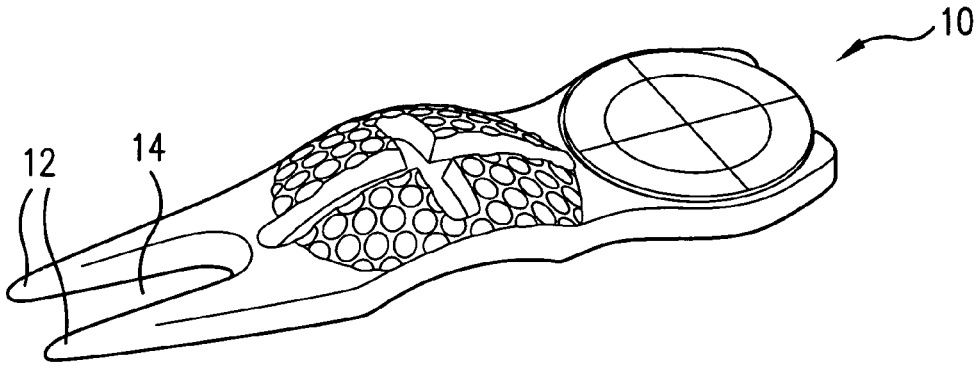
FIG. 1 is a perspective view of the multi-purpose golf accessory assembly, showing a two-prong end section, a cross-slotted semi-hemispherical-shaped middle section, and a magnetic marker end section, the end sections and middle section mounted on a single elongated body member, according to an embodiment of the invention.

The present invention is a uniquely designed device that combines many features and benefits of a traditional divot tool. Traditional divot tools are utilized to repair damaged areas on golf greens caused by the golf ball hitting action on the golf green. In addition to the divot tool feature, the present invention provides additional features that allow for more uses, namely, a golf ball marker, and a golf ball marking instrument.

Referring now to the figures of the drawing, the figures constitute a part of this specification and illustrate an exemplary embodiment of the invention. It is to be understood that in some instances various aspects of the instant invention may be shown exaggerated or enlarged to facilitate an understanding of the invention.

Figure 3:
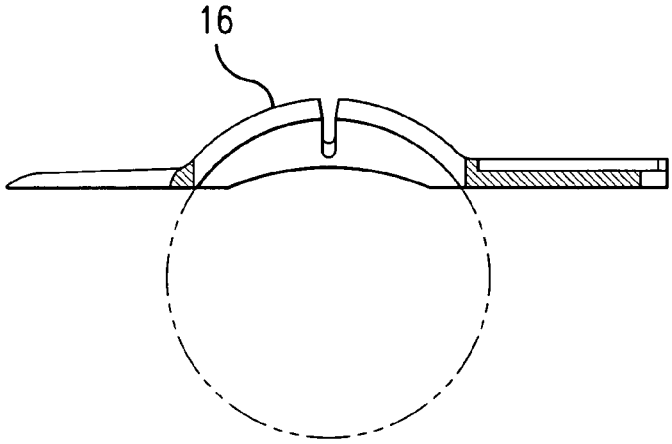
FIG. 3 is a side sectional view of the multi-purpose golf accessory assembly showing a golf ball in a dotted outline mounted under the semi-hemispherical-shaped middle section, according to the embodiment of the invention.
Figure 2:
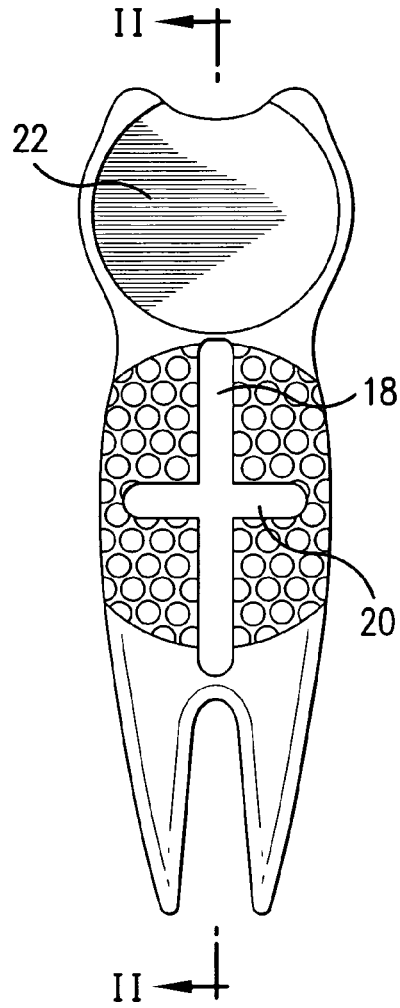
FIG. 2 is a top view of the multi-purpose golf accessory assembly, showing the elongated body member with the embossed magnetic marker end section without the magnetic marker, according to the embodiment of the invention.
Figure 4:
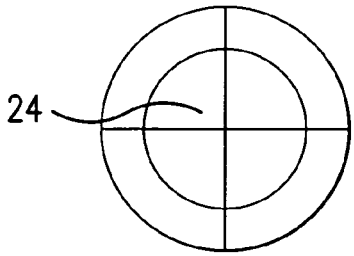
FIG. 4 is a top view of the magnetic marker.

FIGS. 1-4 illustrate a multi-purpose golf accessory assembly which is preferably formed as a single integral metallic elongated body member 10 having three sections: namely, two end sections and a middle section between the end sections. An end section at one end of the body member 10 constitutes a pair of narrow, elongated legs or prongs 12, located side by side in a parallel manner to each other and defines a gap 14 therebetween. The prongs 12 have distal extremities that progressively narrow toward their tips. The prongs 12, among other uses, serve as a ground surface digging tool for repairing damaged turf. The middle section constitutes a semi-hemispherical-shaped portion 16 which is configured in size whereby a golf ball may be easily placed under the semi-hemispherical-shaped portion 16 in an operative horizontal position for marking the ball. The portion 16 has an embedded elongated long slot 18 parallel to the length of the elongated body 10 and an embedded short slot 20 which is perpendicular to the long slot 18. The long slot 18 and the short slot 20 form a cross configuration. The slotted cross constitutes a stencil for placing temporary markings on the golf ball with a suitable writing instrument and forms an alignment system for putting and driving functions. The other end section of the elongated body 10 constitutes an open circular magnetically embossed flat surface 22 and is formed with a beaded edge upstanding from the flat surface to form an embossed magnetically recessed circular area for receiving a removably mounted circular marker piece 24. Accordingly, the marker piece 24 is operatively magnetically secured to the flat surface area 22 in such a way that the golfer can quickly and easily detach the marker piece 24 to mark the position of the golf ball. The golfer can easily re-attach the marker piece 24 to the embossed magnetically recessed circular area 22 when the time comes to play.

Various combinations of colors and line markings may be applied on the elongated body member 10. Such combinations may be utilized to personalize a golfer's ball to distinguish it from other balls which are plated with the same brand. Also, the market piece 24 may include various team names and/or logos that may be applied for advertising purposes.

It is to be understood that when the golfer needs to repair the damaged turf, the golfer holds the elongated body 10 member with the golfer's thumb on the inside of the hemispherical marker section 16 and a golfer's forefinger on the side of the prongs 12. The damaged turf is thus easily repaired. For marking the ball, the golfer holds the elongated body member 10 by the prongs 12 and easily marks the ball through cross slots 18, 20 with the writing instrument. Thus, the markings constitute a putting and driving directional indicator on the dynamic axis of the golf ball.

In summary, the present invention is a multi-purpose golf accessory assembly having an elongated body member having an assembly of components mounted thereon, and wherein the components of the assembly comprises: a divot repair tool on one end of the elongated body member, a removably magnetically mounted marker on the other end of the elongated body member, and a marking instrument mounted between the two ends and having a slot arrangement for marking a directional indicator on a golf ball.

The multi-purpose golf accessory assembly of the present application is identified in the commercial market as a "Crosshairs Divot Tool." The term "Crosshairs" is a pending trademark. For a further understanding of the description and the operation of the multi-purpose accessory assembly of the instant invention, reference is made to the website: www.crosshairsgolf.com. The cross slot configuration of the multi-purpose accessory assembly resembles a cross slot on a gunsight.

The unique ergonomic design of the multi-purpose golf accessory assembly has been created for both comfort and secure finger and thumb placement. The thumb fits comfortably on the formed handle-like portion at a perfect pivot angle to promote correct forward 'pushing' motion. This creates the optimal leverage to repair ball marks properly without damaging the green.

The top handle-like portion of the multi-purpose golf accessory assembly includes the magnetic area that securely holds the removable ball marker. The ball marker can be easily removed with one hand by using the thumb and forefinger and placing pressure on the top part of the ball marker. Also, the ball marker may be custom designed to create a handsome souvenir or memento.

The middle section of the multi-purpose golf accessory assembly has substantially the same diameter as a golf ball. By placing the semi-hemispherical portion of the accessory assembly on the top of the golf ball, the slotted arrangement can be utilized as a stencil to draw lines on the golf ball. This aids with both putting and driving alignment.

The top part of the multi-purpose accessory golf assembly can be utilized as a club grip prop to keep club grips from getting wet. Merely push the prongs of the accessory assembly in the ground and thereby the golf club grip may be propped on the top of the recessed portion of the accessory assembly.

The multi-purpose golf accessory assembly can also be utilized as a club groove cleaner by placing the prongs of the accessory assembly inside the grooves of a golf club iron.

In essence, the multi-purpose golf accessory assembly of the instant invention is both attractively designed and very functional with its many uses as set forth above.

Undoubtedly, other embodiments of the invention will be apparent to those skilled in the art from a consideration of the specification or practice of the invention disclosed herein. For example, the repair tool section could have more than two prongs. Further, the golf ball marker section could have other types of slot arrangements other than the disclosed cross slotted arrangement. It is intended that the specification and examples be considered as exemplary only, with the true spirit of the invention being indicated by the following claims.

What is claimed is:

1. A combined golf assembly implement having an elongated body member having an assembly of components mounted thereon, and wherein the components of the assembly comprises:

a divot green repair tool mounted on one end of the elongated body member, wherein the tool is a plurality of narrow, elongated prong members extending therefrom that define gaps therebetween, a ball marker magnetically mounted on the other end of the elongated body member, a marking stencil mounted between the two ends and having a semi-hemispherical shape for receiving a golf ball thereunder, and wherein the stencil has an embedded slotted cross for guiding markings placed on the golf ball, the marking forming a temporary directional indicator on a dynamic axis of the golf ball.

* * * * *